US008555938B2

(12) United States Patent
Costello

(10) Patent No.: US 8,555,938 B2
(45) Date of Patent: Oct. 15, 2013

(54) INSERTABLE PERSONAL STORAGE DEVICE

(76) Inventor: Jeffrey P. Costello, Knoxvile, TN (US)

( * ) Notice: Subject to any disclaimer, the term of this patent is extended or adjusted under 35 U.S.C. 154(b) by 1106 days.

(21) Appl. No.: 12/126,036

(22) Filed: May 23, 2008

(65) Prior Publication Data

US 2009/0288745 A1 Nov. 26, 2009

(51) Int. Cl.
*A45C 1/06* (2006.01)
*B65D 1/00* (2006.01)

(52) U.S. Cl.
USPC ..... 150/135; 150/138; 150/148; 206/38; 281/18; 281/29

(58) Field of Classification Search
USPC ..... 150/131, 135, 138, 146; 206/38.37; 281/29, 18; 220/200, 660
See application file for complete search history.

(56) References Cited

U.S. PATENT DOCUMENTS

| | | | | |
|---|---|---|---|---|
| 59,618 | A | 11/1866 | Mahon | |
| 631,644 | A | 8/1899 | Klein | |
| 781,948 | A * | 2/1905 | Hegele | 281/19.1 |
| 1,099,708 | A * | 6/1914 | Lynch | 281/17 |
| 1,716,016 | A * | 6/1929 | Upp | 281/30 |
| 2,451,122 | A * | 10/1948 | Sherwood | 150/138 |
| 2,574,885 | A * | 11/1951 | Niswander | 281/4 |
| 2,647,517 | A * | 8/1953 | Bilbrey | 402/4 |
| 4,153,275 | A * | 5/1979 | Phillips | 281/17 |
| 4,909,652 | A | 3/1990 | Harrison | |
| 5,006,699 | A * | 4/1991 | Felkner et al. | 235/462.49 |
| 5,053,749 | A | 10/1991 | Weiss | |
| 5,170,889 | A | 12/1992 | Cue | |
| 5,230,627 | A * | 7/1993 | Todd | 434/109 |
| 5,573,109 | A | 11/1996 | Isacson | |
| 5,706,935 | A | 1/1998 | Lorton | |
| 5,713,406 | A * | 2/1998 | Drury | 150/132 |
| 5,769,213 | A | 6/1998 | Chatterton | |
| 5,778,954 | A | 7/1998 | Sullivan et al. | |
| 5,878,873 | A | 3/1999 | Clark | |
| 5,984,560 | A * | 11/1999 | Bedol et al. | 402/79 |
| D422,406 | S * | 4/2000 | Dweck et al. | D3/247 |
| 6,113,297 | A | 9/2000 | Kovacik | |
| 6,601,622 | B1 * | 8/2003 | Young | 150/138 |
| 6,691,863 | B1 | 2/2004 | Veenstra | |
| 6,923,229 | B2 | 8/2005 | Beckley | |
| 6,997,481 | B1 * | 2/2006 | Hardwig | 281/29 |
| 7,055,682 | B1 * | 6/2006 | Domotor et al. | 206/214 |
| 7,290,953 | B2 | 11/2007 | Regala | |
| 7,316,516 | B2 | 1/2008 | Regala | |
| 2001/0013698 | A1 * | 8/2001 | Soussan | 281/15.1 |
| 2002/0088516 | A1 | 7/2002 | Olson | |
| 2004/0108032 | A1 * | 6/2004 | Lyons | 150/132 |
| 2005/0155618 | A1 * | 7/2005 | Lafferty | 132/104 |
| 2007/0007150 | A1 | 1/2007 | Stacey | |

FOREIGN PATENT DOCUMENTS

| | | |
|---|---|---|
| GB | 1270484 | 4/1972 |
| GB | 2369559 | 6/2002 |
| GB | 2401579 | 11/2004 |

* cited by examiner

*Primary Examiner* — Sue A Weaver
(74) *Attorney, Agent, or Firm* — Luedeka Neely Group, P.C.

(57) ABSTRACT

A personal storage device particularly well adapted to be carried in a foldable wallet or checkbook to occupy heretofore wasted space, providing a secure receptacle selectively closeable and extending parallel to and adjacent the fold line.

15 Claims, 3 Drawing Sheets

INSERTABLE PERSONAL STORAGE DEVICE

FIELD OF THE INVENTION

This invention relates in general to storage devices and, in particular, to a space saving personal storage device which can be carried within an accessory which a person habitually carries on their person, thereby obviating the need for such personal storage device to occupy additional personal space, or require the attention of a separate personal item to be carried on one's person. In a preferred embodiment, the invention can be utilized in a conventional bi-fold wallet or checkbook to provide a storage container or receptacle for personal items such as, for example, medication, a pen or pencil, notes, or any other such item which can be carried by the personal storage device.

BACKGROUND OF THE INVENTION

Whenever one ventures forth from one's home, it is necessary to bring along a number of necessary items which seem to continuously grow in number, for example keys, wallet, cell phone, PDA, pen or pencil, etc. Some of these imperative items continue to get smaller and smaller with scientific and technological breakthroughs, and many times the function of one device is incorporated into another device so that only one of these items is carried instead of both. However, it is still necessary to keep track of all of these items, when gathering them to bring with you, or keeping track of them to prevent their loss.

Regardless of the size or the number of such items which one believes to be necessary to be on one's person, a space must be found on the person to carry these devices or items. Where to conveniently put such items, and how to keep track of them, have become an organizational challenge. Every nook and cranny is sought out to become a place where some necessary device or item can be safely and securely carried on the person. In addition to being able to carry such items on one's person in such a manner, it is much more preferable to make certain that the most important of these items are protected against loss and theft. Available space in a secure location on a person is a most desirable commodity.

Accordingly, it would be very desirable to be able to carry small necessary and/or valuable items on one's person utilizing a heretofore wasted space in an article that is generally and usually carried on the person during daily activities.

SUMMARY OF THE INVENTION

In accordance with one embodiment of the present invention, there is provided a receptacle or container in which small personal items, such as a pen or pencil, pills, written notes, or any other material or object which can be contained within the receptacle, can be placed. The receptacle has joined thereto, or formed therewith, at least one wing tab or flap by which the receptacle can be secured into an item such as a wallet, billfold, checkbook or similar item having at least one fold, and an adjacent opening, pocket, or slit into which the wing tab, or a similar planar element, may be inserted.

The present invention is directed to attaining these goals, and overcoming one or more of the problems or disadvantages associated with the relevant technology, as will be more readily understood and fully appreciated from the following detailed description of one or more preferred embodiments of the present invention.

DESCRIPTION OF THE DRAWINGS

Further objectives of the invention, together with additional features contributing thereto and advantages accruing therefrom, will be apparent from the following description of one or more preferred embodiments of the invention as shown in the accompanying drawings.

DETAILED DESCRIPTION OF PREFERRED EMBODIMENTS

Figure 1:
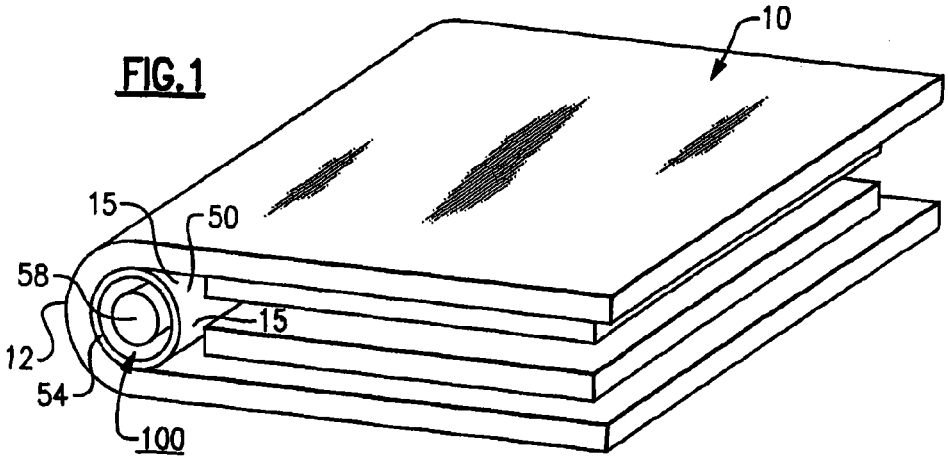
FIG. 1 is a perspective view of one embodiment of the invention in an application environment.
Figure 2:
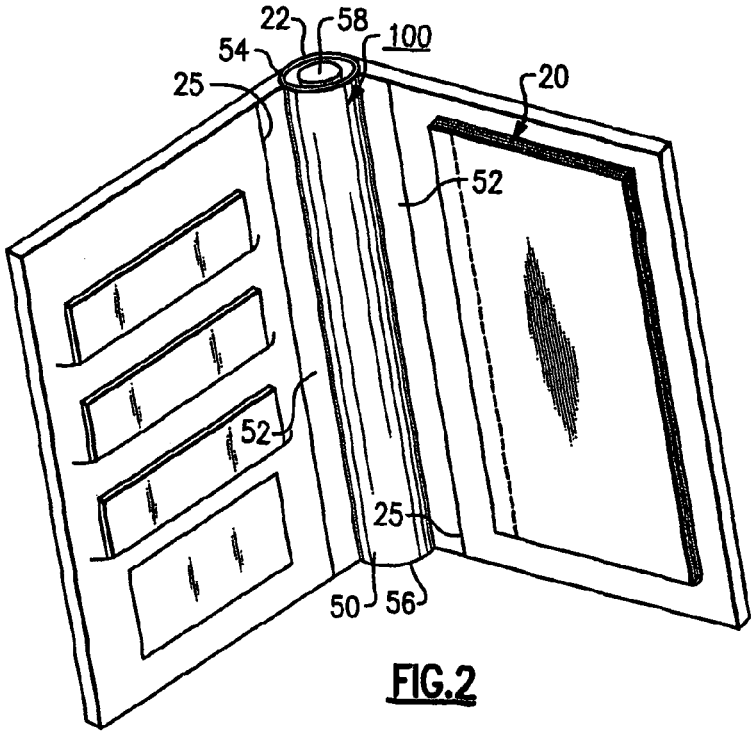
FIG. 2 is another perspective view of the embodiment of the invention illustrated in FIG. 1 in another application environment.

Referring now to the drawings, wherein like reference numerals indicate like parts throughout, there is illustrated in FIG. 1 and FIG. 2 a preferred embodiment of the invention 100 carried in one form of a bi-fold wallet or billfold 10, with the wallet shown closed, and another form of wallet or checkbook 20 with the wallet or checkbook shown open, respectively. As best shown in FIG. 1, when the invention 100 is properly positioned into the wallet 10, as illustrated, a receptacle or container 50 connected to one or more wing tabs or flaps 52 is positioned parallel to and adjacent the wallet fold line 12 in a space heretofore entirely, or substantially entirely, unused, and in FIG. 2 when positioned parallel to and adjacent the fold line 22 of a checkbook 20 to occupy a similar heretofore unused and wasted space.

Figure 3:
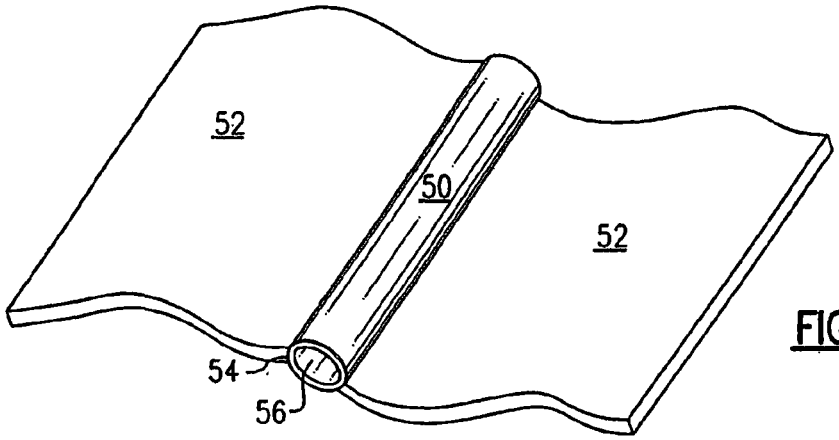
FIG. 3 is a perspective view of the embodiment of the invention illustrated in FIG. 1 without an application environment.
Figure 4:
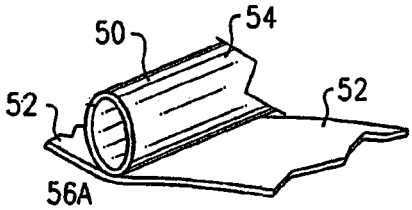
FIG. 4 is another perspective view of an alternative embodiment of the receptacle and wing tabs to better illustrate the structure thereof.
Figure 5:
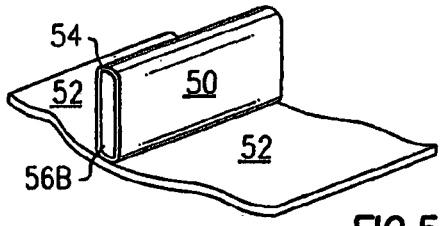
FIG. 5 is another perspective view of an alternative embodiment of the receptacle and wing tabs to better illustrate the structure thereof.

As illustrated in FIG. 3, the receptacle 50 is formed as a hollow thin-walled tube 54, which in this embodiment is formed as a cylinder having a circular cross section 56. However, it is to be understood that the receptacle 50 is not limited to cylinders of that shape, but may be formed, for example, with an egg-shaped or elliptically-shaped cross section **56*a* as illustrated in FIG. 4, an elongated or tear-drop cross section 56*b* as illustrated in FIG. 5, or any other cross sectional shape which will not impede one's ability to close the wallet 10 or checkbook 20 in a normal fashion. It is preferred that the length of the receptacle 50 not exceed the length of the fold line of the wallet or check book with which the receptacle 50** is to be used.

To place the receptacle or container 50 into the wallet 10 or checkbook 20 with which the receptacle 50 is to be used, the wallet or checkbook is opened and at least one wing tab or flap 52 of the receptacle 50 is inserted into one or more of the slots or pockets 15 and 25 which are formed in the wallet 10 or the checkbook 20, respectively, adjacent to their fold lines. These slots or pockets 15 and 25 are formed in the foldable wallet 10 and checkbook 20, respectively, and extend parallel to the wallet or checkbook fold line (12 and 22) and are usually used to carry a driver's license, credit cards, photographs, currency, or transparent carriers for such items, or any other such thin planar items. While the presence of wing tabs or flaps 52 on both sides of the receptacle or container 50 is preferable, a single wing tab or flap 52 may be suitable for positioning and retaining the receptacle 50 in a wallet or checkbook.

Figure 6:
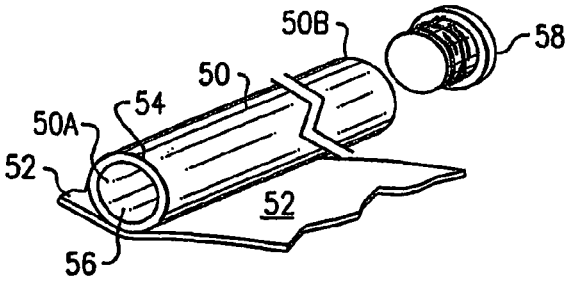
FIG. 6 is an enlarged view of the receptacle or container to better illustrate the construction of an alternative embodiment.
Figure 8:
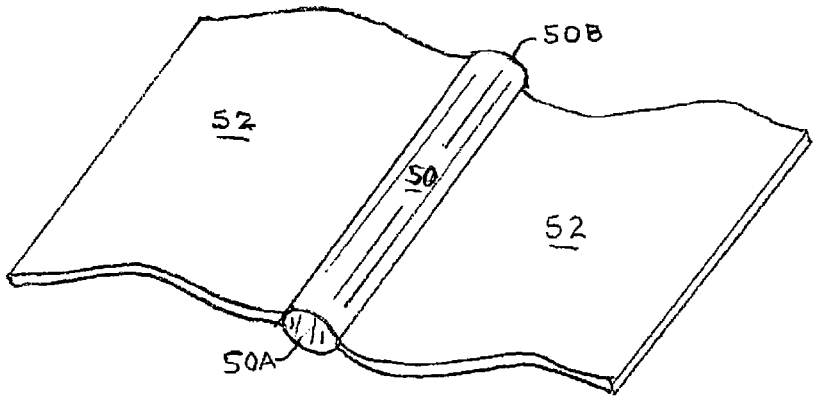
FIG. 8 is another perspective view of an alternative embodiment of the receptacle and wing tabs to better illustrate a sealed embodiment thereof.

The receptacle 50 is preferably formed as a rigid thin-walled thermoplastic cylindrical container 54, with the wing tab or tabs 52 integrally formed as flexible sheet-like flaps during the forming process. It is, however, to be understood that these parts may be formed separately, and then joined together, and other materials such as thin lightweight metal or paperboard can be used for forming these parts. One end 50*a* of the receptacle 50 may be formed as a closed end, and the other end may be open to receive a closure cap 58, as illustrated in FIG. 6, which may be press-fit or threaded to engage and close the open end 50*b* of the receptacle 50. In the event that it would be desirable to incorporate a device for locating the wallet 10 or checkbook 20 if it were stoned or lost, an RF emitter could be placed into the receptacle 50 and both ends 50*a* and 50*b* sealed, as illustrated in FIG. 8.

Figure 7:
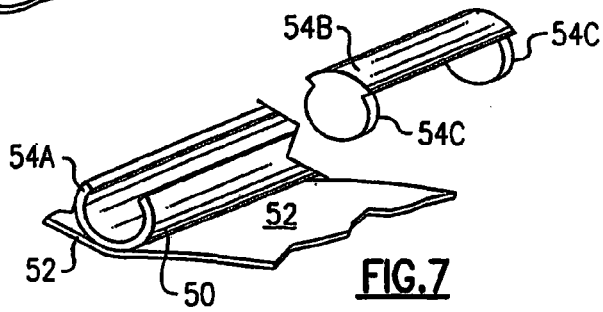
FIG. 7 is another enlarged view of the receptacle or container to better illustrate the construction of another alternative embodiment.

In another embodiment as illustrated in FIG. 7, the receptacle 50 can be formed as a cylindrical channel 54*a* with one or both of the ends open. A suitable closure for the cylinder 54*a* is a complementary shaped partial cylinder 54*b* having one or two closure ends 54*c*, depending upon whether the cylindrical channel 54*a* has one or both ends open. Because of the flexibility of the materials from which the receptacles 50 are constructed, the complementary partial cylinder 54*b* can be snap-fit into engagement with the cylindrical channel 54*a* to close the receptacle.

While this invention has been described in the specification and illustrated in the drawings with reference to preferred embodiments, the structures of which have been disclosed herein, it will be understood by those skilled in the art to which this invention pertains that various changes may be made and equivalents may be substituted for elements of the invention without departing from the scope of the claims. Therefore, it is intended that the invention not be limited to the particular embodiments disclosed in the specification and shown in the drawings as the best mode presently known by the inventor for carrying out this invention, nor confined to the details set forth, but that the invention will include all embodiments, modifications and changes as may come within the scope of the following claims.

This application was prepared without reference to any particular dictionary. Accordingly, the definition of the terms used herein conforms to the meaning intended by the inventor acting as his own lexicographer, in accordance with the teaching of the application, rather that any dictionary meaning which is contrary to or different from the inventor's meaning regardless of the authoritativeness of such dictionary.

What is claimed is:

1. A personal storage device for use with a wallet, checkbook or the like having a fold line about which opposing interior faces are folded upon each other when in a closed position, and at least one slot parallel to and adjacent the fold line, the personal storage device comprising:

a receptacle having an opening therein extending in a direction coaxial to a longitudinal axis of the receptacle for positioning the contents carried therein coaxial with said longitudinal axis and directly adjacent to said fold line;

at least one wing tab connected to said receptacle and extending outwardly therefrom in a plane parallel to the longitudinal axis of said receptacle;

said wing tab adapted to engage a slot formed in a wallet, checkbook or the like with which the personal storage device is to be used, to position said receptacle parallel to and adjacent the fold line about which the opposing interior faces are folded upon each other; and said opening in said receptacle being sealed at both ends to seal the contents therein.

2. The personal storage device of claim 1 wherein said receptacle is a thin walled cylinder.

3. The personal storage device of claim 2 wherein said cylinder has a circular cross section.

4. The personal storage device of claim 2 wherein said cylinder has an elliptical cross section.

5. The personal storage device of claim 2 wherein said cylinder has an egg-shaped cross section.

6. The personal storage device of claim 2 wherein said cylinder has an elongated slot cross section.

7. The personal storage device of claim 1 wherein said wing tab is formed integrally with said receptacle.

8. The personal storage device of claim 1 wherein wing tabs extend outwardly from said plane parallel to the longitudinal axis of the receptacle in opposed directions.

9. A foldable wallet or checkbook and personal storage device, comprising:

a foldable casing having a fold line about which opposing interior faces of the casing are folded upon each other when said casing is folded;

said foldable casing further including at least one slot formed in said casing and extending parallel to and adjacent said fold line;

a personal storage device comprising a receptacle having an opening therein extending in a direction coaxial to a longitudinal axis of said receptacle for positioning the contents carried therein coaxial with said longitudinal axis and directly adjacent to said fold line;

at least one wing tab connected to said receptacle and extending outwardly therefrom in a plane parallel to the longitudinal axis of said receptacle;

said wing tab positioned to engage said casing slot formed in said casing to releasably secure said receptacle to said casing;

said receptacle positioned parallel to and adjacent said fold line when said wing tab is positioned in engagement with said casing slot; and wherein said opening in said receptacle is sealed at both ends to seal the contents therein.

10. A foldable wallet or checkbook and a personal storage device as defined in claim 9 wherein said foldable casing includes at least two slots in said casing, each of said slots extending parallel to and positioned adjacent said fold line;

one of said slots being positioned on each opposed interior face of said casing;

at least two wing tabs connected to said receptacle, each one of said wing tabs extending outwardly therefrom in a plane parallel to the longitudinal axis of said receptacle in a direction opposite to the other said wing tab;

each one of said wing tabs positioned to mutually exclusively engage one of said casing slots to releasably secure said receptacle in a position parallel to and adjacent said fold line between said casing slots.

11. The foldable wallet or checkbook and personal storage device as defined in claim 9 wherein said receptacle is a thin walled cylinder.

12. The foldable wallet or checkbook and personal storage device as defined in claim 11 wherein said cylinder has a circular cross section.

13. The foldable wallet or checkbook and personal storage device as defined in claim 11 wherein said cylinder has an elliptical cross section.

14. The foldable wallet or checkbook and personal storage device as defined in claim 11 wherein said cylinder has an egg-shaped cross section.

15. The foldable wallet or checkbook and personal storage device as defined in claim 11 wherein said cylinder has an elongated slot cross section.

* * * * *